United States Patent [19]

Litt

[11] 4,133,070

[45] Jan. 9, 1979

[54] SCARIFYING TOOL FOR PIPE ENDS

[76] Inventor: Sanford Litt, 27050 Cedar Rd., Beechwood, Ohio 44122

[21] Appl. No.: 802,779

[22] Filed: Jun. 2, 1977

Related U.S. Application Data

[63] Continuation-in-part of Ser. No. 670,346, Mar. 25, 1976, Pat. No. 4,038,715.

[51] Int. Cl.[2] ..... A46B 3/18; A46B 7/00

[52] U.S. Cl. ..... 15/106; 15/104.04; 15/104.05; 15/206; 51/392

[58] Field of Search ..... 15/104.03, 104.04, 104.05, 15/104.2, 106, 160, 184, 206; 51/391, 392, 205 R, 354

[56] References Cited

U.S. PATENT DOCUMENTS

| | | | |
|---|---|---|---|
| 1,710,127 | 4/1929 | Vaughn | 15/106 |
| 1,838,958 | 12/1931 | Page | 15/106 X |
| 1,950,862 | 3/1934 | Page | 15/106 |
| 3,088,150 | 5/1963 | Sweeney | 15/106 |
| 3,224,029 | 12/1965 | Domingos | 15/104.04 X |
| 4,038,715 | 8/1977 | Litt | 15/106 |

FOREIGN PATENT DOCUMENTS

| | | | |
|---|---|---|---|
| 946560 | 5/1974 | Canada | 15/106 |
| 367841 | 1/1923 | Fed. Rep. of Germany | 15/206 |

*Primary Examiner*—Edward L. Roberts
*Attorney, Agent, or Firm*—Fay & Sharpe

[57] ABSTRACT

A tool for scarifying at least end areas of generally cylindrical members has a wire brush mounted thereto against axial and rotational movement by securing a brush mounting member to an end portion of the brush spine and trapping the mounting member between separable parts forming a body member of the tool. A hole through the body member for receiving at least the ends of cylindrical members is lined with scarifying material, and elastomeric material is positioned between the peripheral surface of the tool and the scarifying material for providing yielding movement of the scarifying material radially of the hole axis.

13 Claims, 9 Drawing Figures

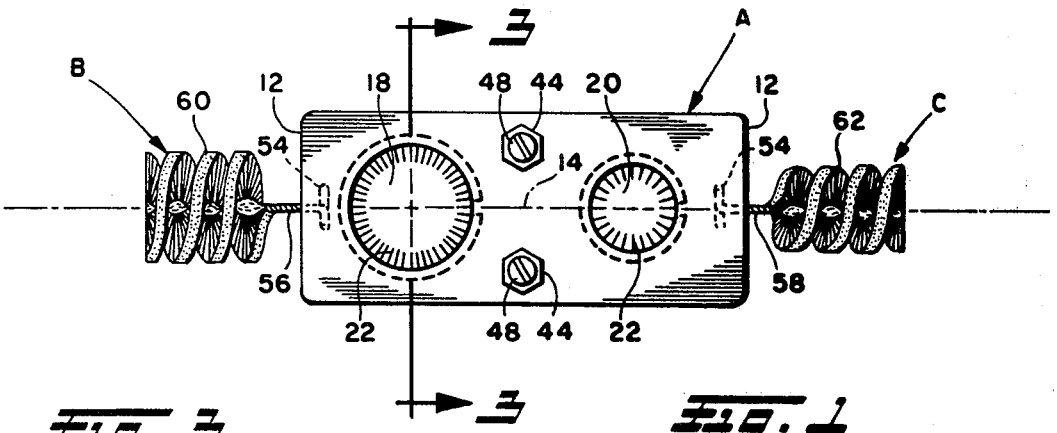
Fig. 1
Fig. 3
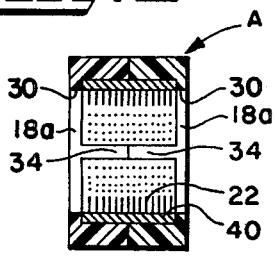
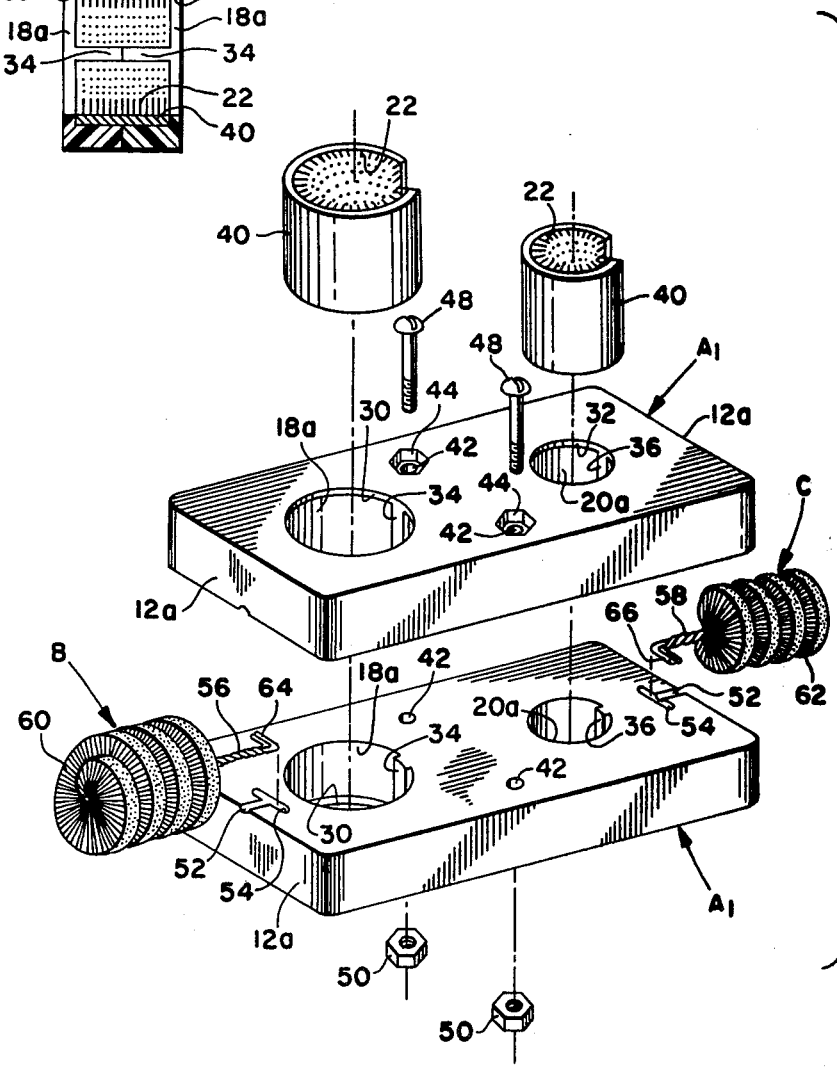
Fig. 2

SCARIFYING TOOL FOR PIPE ENDS

BACKGROUND OF THE INVENTION

This application is a continuation-in-part of Ser. No. 670,346, filed Mar. 25, 1976, now U.S. Pat. No. 4,038,715.

This invention pertains to the art of scarifying tools and, more particularly, to scarifying tools of the hand held type.

The invention is particularly applicable to scarifying tools for scarifying the ends of pipe or the like and will be described with particular reference thereto. However, it will be appreciated that the invention has broader aspects and the tool may be used for scarifying members other than pipes.

Prior to soldering or adhesively joining the ends of metal or plastic pipe and fittings, it is common to scarify the inner and outer ends of the pipes and fittings for cleaning and deburring those surfaces which receive the solder or adhesive. Various scarifying tools have been developed for performing scarifying operations of this type. U.S. Pat. No. 3,168,799 issued Feb. 9, 1965, to Johnson discloses an abrasive tool wherein a plurality of abrasive members have abrasive grit on the outer surfaces thereof. The individual abrasive members must be tapped and threaded for receiving threaded extensions on the tool and for receiving setscrews to lock the abrasive members in position. Tapping and threading are expensive procedures. Abrasive grit tends to become worn away or clogged so it loses its effectiveness quite rapidly. U.S. Pat. No. 3,557,496 issued Jan. 26, 1971, to Martin discloses an abrasive tool wherein a highly flexible body member has abrasive projections secured to its opposite ends by screws. It is rather difficult to use the abrasive end projections when the body member is highly flexible. Securing the abrasive projections to the body member with axially extending screws creates the possibility that the screws and abrasive projections will become loose during use. The abrasive grit also loses its effectiveness by wearing away or becoming clogged. U.S. Pat. No. 3,634,982 issued Jan. 18, 1972, to Martin discloses an abrasive tool wherein the opposite ends have projections integral with the body member. The abrasive grit is either bonded to the projections or is mixed in the material from which the tool is molded. Abrasive projections using grit often make line contact with a pipe end so that the pipe end is not fully cleaned around its full circumference or along the full length of the end portion to be joined.

It would be desirable to have an arrangement wherein scarifying devices could be secured to a body member in an inexpensive manner. It would also be desirable to have an arrangement which would permit the use of wire brushes which are often longer lasting than abrasive grit and perform a more thorough scarifying operation.

SUMMARY OF THE INVENTION

A tool for scarifying the ends of pipe or similar, generally cylindrical surface areas includes a generally rigid body member adapted to be held in a person's hand for manipulation. The body member has opposite ends and a longitudinal axis extends across such ends. Wire brushes defining scarifying devices are manufactured separate from the body member and are secured to the body member against axial and rotational movement relative thereto in outwardly extending relationship to the opposite ends of the body member. The brushes have longitudinal brush axes extending generally parallel to the longitudinal axis of the body member and generally circular cross-sectional configurations perpendicular to the brush axes.

In a preferred arrangement, the brushes or other scarifying devices include integral mounting means extending outwardly therefrom for mounting the scarifying devices to the body member. The brushes may be of the type including central twisted wire spines having wire bristles secured thereto along a portion of the spine length so that the remainder of the spine length defines the mounting means.

The body member is preferably formed in a pair of parts which are joined together on joining surfaces extending generally parallel to the longitudinal axis of the body member. The pair of parts are preferably substantially identical halves. With the brushes or scarifying devices having integral mounting means extending outwardly therefrom, the pair of parts have receiving means along their joining surfaces for receiving the mounting means. The receiving means may comprise grooves having longitudinal groove portions extending generally parallel to the longitudinal axis of the body member and transverse groove portions. The mounting means includes longitudinal and transverse mounting portions respectively received in the longitudinal and transverse groove portions.

The pair of parts forming the body member may be separably secured together for easy replacement of the scarifying devices.

In accordance with another arrangement, the wire brushes are mounted to the body member of the tool by securing mounting members to end portions of the central twisted wire brush spines. The free end portions of the mounting members have lateral extensions which extend transversely of the brush spines.

In another aspect of the invention, a hole in a body member is lined with scarifying material for scarifying the outer area of a cylindrical member received in the hole. Yieldable biasing means is positioned between the scarifying material and the peripheral surface of the hole for normally biasing the scarifying material generally radially toward the hole axis and allowing yielding movement of the scarifying material away from the hole axis. The biasing means is preferably in the form of elastomeric material.

It is a principal object of the invention to provide an improved scarifying tool for pipe ends or similar generally cylindrical members.

It is another object of the invention to provide such a scarifying tool which is very economical to manufacture and assemble.

It is still another object to provide such a scarifying tool in which it is inexpensive and simple to replace the operative component parts as they become worn.

It is a further object of the invention to provide such a tool having projecting wire brushes secured thereto without the use of threaded fasteners such as setscrews or the like.

It is an additional object of the invention to provide a scarifying tool with holes for receiving at least the end portions of cylindrical members, and with the holes being lined with scarifying material in a manner allowing radial movement of the scarifying material relative to the axis of the hole.

It is another object of the invention to provide an improved arrangement for mounting wire brushes to a holder by securing mounting members to end portions of the brush spines.

BRIEF DESCRIPTION OF THE DRAWING

The invention may take physical form in certain parts and arrangements of parts, a preferred embodiment of which will be described in detail in this specification and illustrated in the accompanying drawings which form a part hereof and wherein:

FIG. 1 is a plan view of a scarifying device constructed in accordance with the present invention;

FIG. 2 is a perspective illustration thereof;

FIG. 3 is a partial cross-sectional elevational view taken generally along lines 3—3 of FIG. 1;

DESCRIPTION OF PREFERRED EMBODIMENTS

Figure 4:
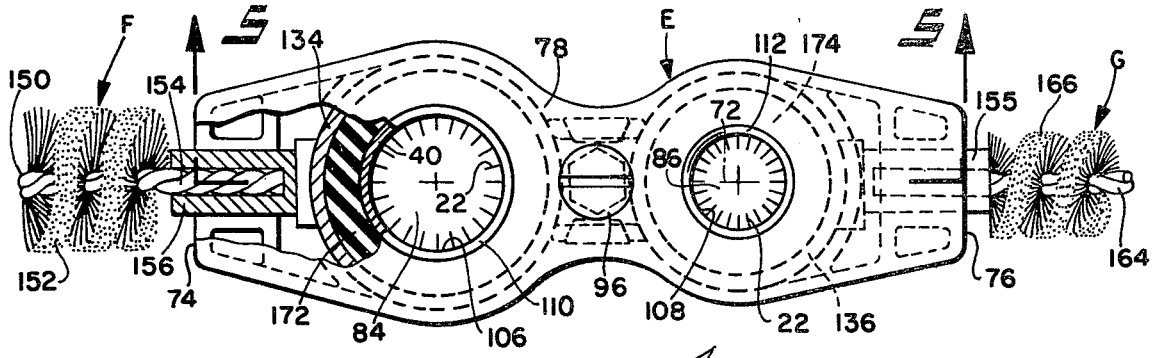
FIG. 4 is a plan view of another embodiment of a scarifying device constructed in accordance with the present invention.

Referring now to the drawings wherein the showings are for purposes of illustrating preferred embodiments of the invention only and not for purposes of limiting same, FIG. 1 shows a scarifying tool including a body member A which is preferably dimensioned and shaped for being held in a person's hand for manipulation. Body member A includes opposite ends 12 across which a longitudinal axis 14 extends. Wire brushes B and C are secured to body member A against axial and rotational movement relative thereto, and are positioned in outwardly extending relationship to opposite ends 12. Wire brushes B and C have longitudinal brush axes extending parallel to longitudinal axis 14, and in the arrangement shown, the longitudinal brush axes are coincidental with longitudinal axis 14.

Spaced-apart different sized holes 18,20 lying along axis 14 extend through body member A. Holes 18, 20 are lined with generally radially inwardly extending wire bristles indicated by numeral 22. Pipe ends are extendable through holes 18, 20 and rotational manipulation of the tool about the axis of the hole through which the pipe end extends will then scarify the pipe end by action of wire bristles 22.

As best shown in FIG. 2, body member A of FIG. 1 is assembled from a pair of substantially identical half parts $A_1$. Each half part $A_1$ has an outer surface 26 and an opposite place joining surface 28. Holes 18*a*,20*a* through each half part $A_1$ cooperate with one another in the assembled condition of half parts to define holes 18, 20 in body member A.

As best shown in FIG. 3, each hole 18*a* has an inwardly extending flange 30 adjacent the ends thereof closest to outer surface 26. Hole 20*a* has a similar flange 32. A relatively narrow vertical rib or the like 34, 36 may extend the length of each hole 18*a*,20*a* so that the circumference of each hole beneath its flange 30, 32 is somewhat less than 360°.

Backing strips 40 of cardboard, canvas, rubber-like material or the like have wire bristles 22 secured thereto and extending inwardly therefrom. Strips 40 are deformable for insertion into holes 18 and 20. Strips 40 have a length and width to fit snuggly within the holes between flanges 30, 32 when parts $A_1$ are assembled together to form body member A. The ends of strips 40 abut ribs 34, 36 to prevent rotation of the strips relative to the holes. The strips could be adhesively secured in the holes and other types of abrasive material could also be employed to line the holes.

Suitable holes 42 through each part $A_1$ have polygonal counterbores 44 adjacent outer face 26. Screws 48 extend through holes 42 for cooperation with nuts 50 received in polygonal counterbores 44 to secure half parts $A_1$ together to form the scarifying tool. The heads of screws 48 are dimensioned to fit within counterbores 44 in order that the outer surfaces of body member A will have no projecting screw or nut portions.

Joining surface 28 has generally T-shaped grooves therein adjacent opposite ends 12*a*. These grooves include a longitudinal groove portion 52 intersecting a transverse groove portion 54. Longitudinal groove portions 52 extend to ends 12*a* and are parallel to longitudinal axis 14. Each brush B and C includes a twisted wire spine 56, 58 respectively in which wire bristles 60, 62 are secured. Axially elongated brushes B and C include spine end portions which extend beyond bristles 60, 62 and terminate in transverse spine end portions 64, 66 respectively. Therefore, the portions of spines 56, 58 extending longitudinally beyond bristles 60, 62 are receivable in longitudinal groove portions 52 while transverse spine portions 64, 66 are receivable in transverse groove portions 54 on one side of longitudinal groove portion 52.

The bare length of each spine 56 and 58 extending beyond bristles 60 and 62 may be considered an integral mounting means which projects or extends outwardly from each scarifying device B or C. This mounting means includes longitudinal and transverse mounting portions. Parts $A_1$ have receiving means for receiving the mounting means on the scarifying devices. The receiving means comprise longitudinal grooves 52 and transverse grooves 54 which respectively receive the longitudinal and transverse mounting portions.

Although body member A is shown in the FIGURES as being rectangular, other various shapes may be used so as to accommodate the body portion to a person's hand without departing from the intent or scope of the present invention. The parts forming the body member are preferably molded of relatively rigid synthetic plastic material although other materials could also be advantageously employed. It will also be recognized that parts $A_1$ may be alternatively secured together by ultrasonic welding, adhesive, rivets and the like.

One part $A_1$ is rotated 180° or flipped about axis 14 relative to the other part and the mounting portions of brushes B and C are positioned in the grooves. The two parts are then secured together. Strips 40 may then be positioned in holes 18 and 20. Brushes B and C have longitudinal brush axes which are substantially coincidental with axis 14 of body member A. In general, it may be said that the longitudinal axes of the brushes extend substantially parallel to longitudinal axis 14. Brushes B and C preferably have circular cross-sectional configurations perpendicular to their longitudinal axes. In a preferred arrangement, brushes B and C are generally cylindrical, although it is possible to utilize brushes having the general shape of truncated cones.

Brushes B and C are preferably of different sizes so that one could be used to scarify the inner end portion of one size pipe while the other would be used to scarify the inner end portion of another size pipe. In the arrangement using screws and nuts or other separable fasteners for holding parts $A_1$ together, it is possible to remove or replace brushes B and C. With wire bristles 60 and 62 extending along only a portion of the length of spines 56 and 58, the remainder of those spines define the integral mounting means extending outwardly from the brushes. The longitudinal and transverse mounting portions of the brushes are firmly trapped between the two parts forming body member A so that the brushes cannot rotate or move axially relative to the body member. Joining surfaces 28 extend parallel to longitudinal axis 14. Even though only one leg of transverse groove portion 54 is required for receiving transverse mounting portion 64 or 66, the grooves are T-shaped in order that the two parts may be substantially identical and one may be flipped.

In addition to scarifying the ends of pipe or tubing as hereinabove described, the subject hand tool may also be advantageously employed for many other purposes. For example, it may also be used to scarify battery terminals, battery cable ends and the like. Moreover, it may also be used in any environment where a generally cylindrical internal and/or external surface area is to be scarified.

FIGS. 4–9 show another embodiment wherein a body member E is contoured to fit comfortably within a person's hand. Body member E has a central longitudinal axis 72 extending across opposite ends 74 and 76, and scarifying devices in the form of wire brushes F and G are secured to body member E in outwardly extending relationship to opposite ends 74 and 76 thereof. Body member E has opposite substantially plane outer surfaces 78 and 80, and holes 84 and 86 extend across such surfaces through body member E. Each hole 84 and 86 has a central longitudinal axis 88 and 90 extending perpendicular to body member longitudinal axis 72 and intersecting same.

Body member E is formed from a pair of separable parts 92 and 94 separably secured together by a screw 96 freely extending through a centrally located countersunk hole 98 in part 92 into threaded engagement with a nut 99 positioned in a centrally located hexagonal recess 102 in surface 80 of part 94 aligned with screw receiving hole 103. Part 92 may be considered a cover part, while part 94 may be considered a holder part. The two parts are secured together generally parallel to longitudinal axis 72 and may be considered as secured together generally along a plane extending perpendicular to axes 88 and 90 of holes 84 and 86. Cover part 92 has longitudinally spaced different size circular openings 106 and 108 therethrough. Inwardly sloping surfaces 110 and 112 extend from outer surface 78 toward openings 106 and 108 for guiding generally cylindrical members through openings 106 and 108. Generally cylindrical cavities 114 and 116 are provided in cover part 92 around openings 106 and 108. Longitudinally spaced aligned rectangular notches 119 and 120 of the same size and shape are provided at the opposite end portions of cover part 92. Opposite parallel side walls 121 span notches 119 and 120, and cooperate therewith to define longitudinal grooves of generally rectangular cross-sectional configuration which open outwardly at the opposite ends of cover part 92. Cavities 122 inwardly of notches 120 reduce the amount of material used to mold or cast part 92, and also define transverse groove portions which extend generally perpendicular to the longitudinal grooves. A cylindrical wall portion 123 is located on the opposite side of each cavity 122 from notches 120. A plurality of other cavities or recessed areas in cover part 92 are all indicated by numeral 124 and are provided simply to save on the material used to mold or cast the part.

Figure 5:
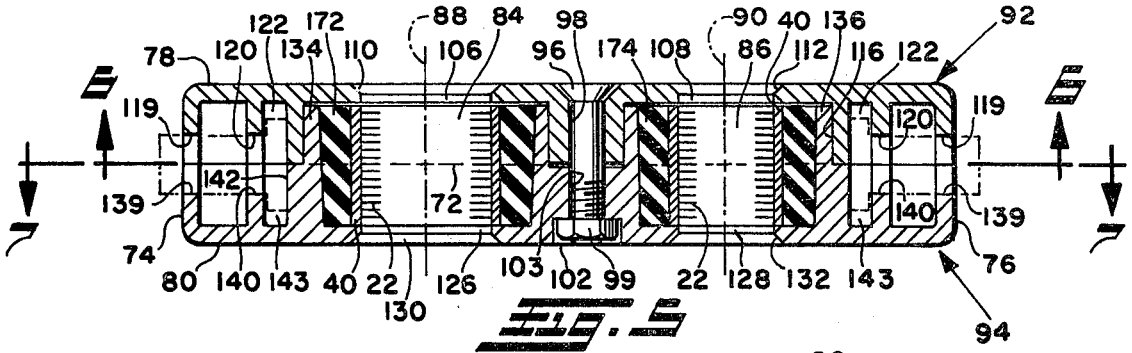
FIG. 5 is a cross-sectional elevational view taken generally on lines 5—5 of FIG. 4 and with the brushes omitted for clarity of illustration.
Figure 6:
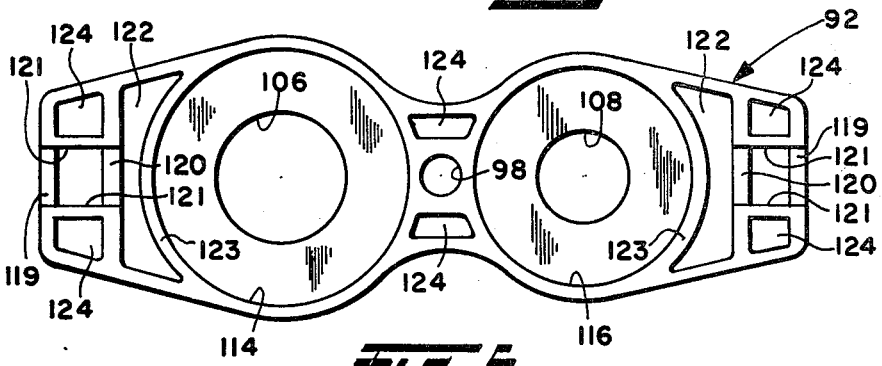
FIG. 6 is a plan view of one body member part looking generally in the direction of arrows 6—6 of FIG. 5.
Figure 9:
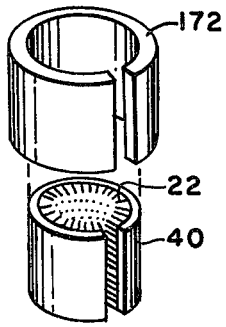
Figure 7:
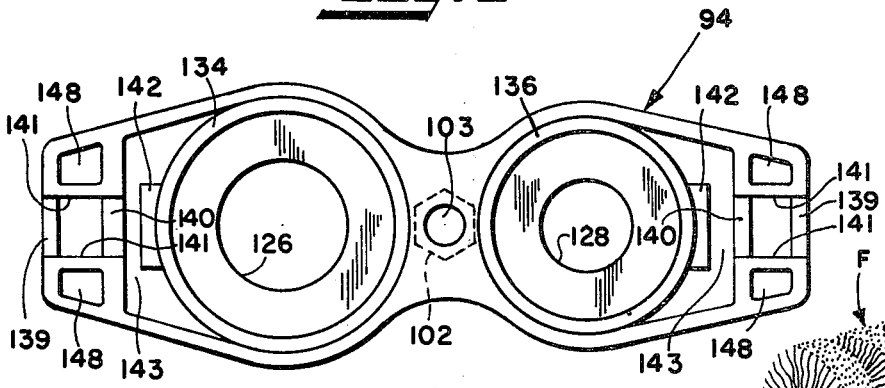
FIG. 7 is a plan view of another body member part looking generally in the direction of arrows 7—7 of FIG. 5.

Holder part 94 has longitudinally spaced circular openings 126 and 128 therethrough. Inwardly sloping surfaces 130 and 132 extend from outer surface 80 toward openings 126 and 128 to facilitate insertion of generally cylindrical members through the openings. Generally cylindrical projections 134 and 136 are located radially outwardly around openings 126 and 128, and extend past longitudinal axis 72 of body member E toward cover part 92 when the parts are assembled as best shown in FIG. 5. Longitudinally-spaced aligned rectangular grooves 139 and 140 of the same size and shape are provided at the opposite end portions of holder part 94. Opposite parallel side walls 141 span notches 139 and 140, and cooperate therewith to define longitudinal grooves of generally rectangular cross-sectional configuration which open outwardly at the opposite ends of holder part 94. Cavities between notches 140 and abutments 142 on projections 134 and 136 define transverse groove portions 143 extending generally perpendicular to the longitudinal grooves and to longitudinal axis 72 of body member E.

With cover and holder parts 92 and 94 assembled together as in FIG. 4, transverse groove 122 in cover part 92 extends from the longitudinal groove therein in a direction away from holder part 94. Likewise, transverse groove 143 in holder part 94 extends from the longitudinal groove therein in a direction away from cover part 92. The longitudinal and transverse grooves in each part 92, 94 cooperate to define generally L-shaped grooves. With parts 92 and 94 assembled together, the longitudinal and transverse grooves in the two parts are aligned in opposed relationship to define generally T-shaped sockets. A plurality of other cavities or recesses in holder part 94 are all indicated by numeral 148 and are simply provided to save on the materials used in molding or casting the parts.

Figure 8:
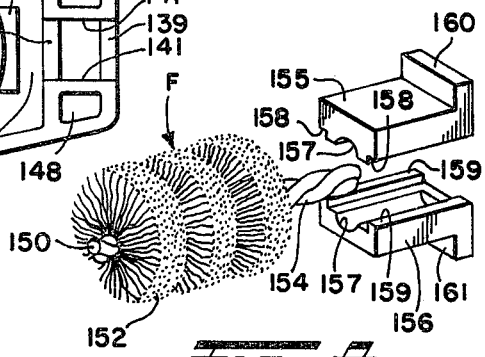
FIG. 8 is an exploded perspective illustration of a brush and brush mounting member used in the tool of FIG. 4; and, FIG. 9 is a perspective illustration of a lining for holes in the handle portion of the tool.

FIG. 8 shows a wire brush F including an elongated central twisted wire spine 150 having wire bristles 152 secured thereto along a portion of its length and having a spine end portion 154 free of bristles. A mounting member in the form of opposed mounting parts 155 and 156 is secured to brush spine end portion 154. Each part 155 and 156 has an elongated semicylindrical groove 157 and the two grooves cooperate to define a cylindrical bore of at least slightly smaller diameter than spine end portion 154. The grooves, and therefore the bore they define, does not extend completely through parts 155 and 156. This simplifies assembly of the parts to a brush spine because the terminal end of the brush spine can be butted against the blind end of the grooves or bore. Mounting part 155 has opposite longitudinal rabbets 158 for receiving longitudinal tongues 159 on part 156. Transverse portions 160 and 161 in the form of outwardly extending flanges are provided on the rear or free ends of parts 155 and 156. Mounting parts 155 and 156 are tightly clamped together on opposite sides of a brush spine end portion 154, with such spine end portion tightly gripped between grooves 157. Parts 155 and 156 are then ultrasonically welded together at least along the engaging surfaces of rabbets 158 and tongues 159. For that purpose, parts 155 and 156 are made of suitable synthetic plastic material. However, it will be appreciated that other materials including metal could be used for parts 155 and 156, and they could be secured together in other ways as with adhesive or mechanical fasteners. In addition, adhesive or formed surfaces can be used between grooves 157 and spine free end 154 if so desired. Cooperating mounting parts 155 and 156 define the mounting means for mounting brush F to body member E. Brush G is also formed with an elongated central twisted wire spine 164 having bristles 166 secured thereto along a portion of its length. Obviously, the mounting means for mounting the brushes to the body member can take many other forms. By way of one example only, metal tubes can be crimped onto the brush spine end portions and the free rear end portions of the tubes bent transversely so the tubes are generally L-shaped for reception in L-shaped grooves between cover and holder parts 92, 94.

A strip 172 of elastomeric material is positioned between projection 134 and carrier 40 for bristles 22 defining the scarifying means lining hole 84. Likewise, a strip 170 for the elastomeric material is positioned between projection 136 and strip 40 carrying bristles 22 defining the scarifying means lining hole 86. Strips 172 and 174 define yieldable biasing means for normally biasing the scarifying material defined by bristles 22 generally radially inwardly toward hole axes 88 and 90. The strips allow radial outward movement of the scarifying material defined by bristles 22 because the strips are compressible. This makes it possible to dimension holes 84 and 86 in such a manner that the scarifying material defined by bristles 22 will firmly and uniformly engage the exterior and surfaces of standard size pipes or the like. The yieldability of the elastomeric strips allows easy insertion of the pipe ends into the holes, while maintaining firm engagment of the bristles with the exterior surfaces of pipes for good scarifying action. The yieldable biasing means defined by elastomeric strips 172 and 174 may be formed from any suitable material including natural or neoprene rubber, or silicone rubber. Various synthetic plastic materials can also be used. The elastomeric material is preferably quite soft and compressible as opposed to a relatively dense and rigid elastomer. It is also possible to use elastomeric material having closed or open air cells therein. In addition to providing yielding movement of the scarifying matrial lining holes 84 and 86, strips 172 and 174 provide a very high coefficient of friction to prevent rotation of carrier strips 40 relative to body member 80. Thus, it is not always necessary to provide a longitudinal rib such as ribs 34 and 36 in the embodiment of FIGS. 1–3. Although such ribs can be provided for preventing rotation of both the elastomeric strips and the scarifying material, it has been found that use of elastomeric strips makes the ribs unnecessary. This simplifies construction of the die for molding or casting parts 92 and 94.

The parts forming body member E may be molded or cast of any suitable material including synthetic plastic or metal. In one preferred embodiment, the parts 92 and 94 have been die cast from aluminum. However, it will be appreciated that other metals such as zinc could be used, and the parts could also be cast of plastic.

When cover part 92 and holder part 94 are assembled together as shown in FIG. 5, openings 106 and 126 cooperate to define hole 84, while openings 108 and 128 cooperate to define hole 86. Projections 134 and 136 are spaced radially outwardly from the openings to provide a generally cylindrical space between the openings and the inner peripheral surfaces of the projections for receiving the elastomeric strips and the scarifying material. The inner cylindrical surfaces or projections 134 and 136 also define the peripheral surfaces of holes 84 and 86. Projections 134 and 136 on holder part 94 are closely received within recesses 114 and 116 in cover part 92. The width of strips 172 and 174, and of carrier strips 40, is approximately the same as the projecting lengths of projections 134 and 136. It will be recognized that it is possible to bond or otherwise secure scarifying materials directly on the inner surfaces of elastomeric strips 172 and 174. The arrangement shown is simply illustrative and includes separate carrier strips 40 for the scarifying material defined by wire bristles 22. If desired, it will be recognized that carrier strips 40 can also be bonded to the elastomeric strips.

The T-shaped sockets formed between cover and holder parts 92 and 94 are defined by notches 119, 120, 139 and 149, by walls 121 and 141, and by transverse groove portions 122 and 143. These sockets are shaped for closely receiving the brush mounting members defined by parts 155 and 156 after such parts have been secured together on a brush spine. The brush mounting member defined by parts 155 and 156 is simply positioned in the notches of the cover or holder part with transverse portion 160 or 161 received in transverse groove 122 or 143. The cover and holder parts 92 and 94 are then secured together with screw 96 and nut 99. This firmly locks the brushes and accompanying mounting members to body member E against axial and rotational movement relative thereto. Longitudinal grooves 120 and 140, and 122 and 142, on parts 92 and 94, cooperate to define longitudinal circular holes coincidental with axis 72, and opening outwardly at opposite ends 74 and 76 of body member E.

In the arrangement shown and described, elastomeric strips 172 and 174 have a radial thickness which is substantially greater than the radial thickness of carrier strips 40 to provide a relatively wide range of radial movement for the scarifying material lining the holes.

It has been found that it is sometimes relatively difficult to permanently deform the spines themselves of the wire brushes as in the embodiment of FIGS. 1–3. Therefore, the arrangement of FIGS. 4–9 provides an alternative to permanent deformation of the spines themselves by using mounting means in the form of mounting parts 155 and 156 which are permanently secured to the brush spines, and shaped for cooperation with the grooves between the two parts forming the body member, to mount the brushes against axial or rotational movement.

The invention has been described with reference to a preferred embodiment. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. A hand held scarifying tool comprising: a substantially rigid body member having a longitudinal axis, opposite outer surfaces and opposite ends, said body member being formed by a pair of separable parts separably joined together generally parallel to said axis and defining a cover part and a holder part, scarifying devices having mounting means trapped between said parts against axial and rotational movement in outwardly extending relationship to said opposite ends, cooperating aligned openings in said parts defining a hole through said body member across said outer surfaces, said hole having a peripheral surface, said holder part having a cylindrical projection spaced outwardly from said opening therein and extending past said longitudinal axis of said body member toward said cover part, said projection having an inner surface defining said peripheral surface of said hole, said cover part having a generally cylindrical cavity closely receiving at least a portion of said projection, and scarifying material lining said peripheral surface.

2. The tool as defined in claim 1 including elastomeric material positioned between said peripheral surface of said hole and said scarifying material.

3. The tool as defined in claim 1 wherein said scarifying devices comprise wire brushes including central wire spines having spine end portions, said mounting means comprising mounting members receiving said spine end portions and being secured to a straight and undeformed length of said spine end portions against axial and rotational movement relative thereto without relying upon lateral deformation of said spine end portions to prevent either axial or rotational movement between said mounting member and said spine end portions and without the use of mechanical fasteners.

4. The tool as defined in claim 3 wherein said mounting members include opposed parts secured together on opposite sides of said spine end portions in firm gripping relationship to said spine end portions.

5. The tool as defined in claim 1 wherein said holder part has generally L-shaped grooves including a first groove portion extending axially between said cover and holder parts from said opposite ends of said body member and second groove portions extending from said first groove portions into said holder part in a direction away from said cover part, said mounting means comprising mounting members secured to said scarifying devices against axial and rotational movement relative thereto and being cooperatively shaped for reception in said first and second portions of said grooves to hold said mounting members against axial and rotational movement relative to said parts of said body member.

6. A tool for scarifying at least the outer ends of generally cylindrical areas comprising; a generally rigid body member adapted to be held in a person's hand for manipulation, at least one hole in said body member lined with scarifying material for receiving at least the ends of generally cylindrical members to scarify the exterior surfaces of same, said hole having a peripheral surface and a longitudinal axis, said scarifying material being secured to a flexible carrier, and elastomeric material defining yieldable biasing means positioned between said flexible carrier and said peripheral surface for normally biasing said scarifying material toward said axis and allowing yielding movement of said scarifying material away from said axis.

7. The tool as defined in claim 6 wherein said elastomeric material has a thickness radially of said axis which is substantially greater than the thickness of said carrier radially of said axis, and is substantially softer and more compressible than said carrier, and said elastomeric material being separate from and unsecured to said carrier.

8. A tool for scarifying at least the outer ends of generally cylindrical areas comprising; a generally rigid body member adapted to be held in a person's hand for manipulation, a hole completely through said body member and having a hole longitudinal axis and a hole peripheral surface, said body member being formed in two parts joining together generally along a joining plane extending perpendicular to said hole longitudinal axis, each said part having an opening therein cooperating to define said hole, one said part having a cylindrical projection spaced outwardly from said opening therein and extending toward the other of said parts, said projection having an inner surface defining said peripheral surface of said hole, said hole being lined with scarifying material for receiving at least the ends of generally cylindrical members to scarify the exterior surfaces of same, and yieldable biasing means positioned between said scarifying material and said peripheral surface of said hole for normally biasing said scarifying material toward said hole longitudinal axis and allowing yielding movement of said scarifying material away from said axis.

9. A tool for scarifying at least the outer ends of generally cylindrical areas comprising; a generally rigid body member adapted to be held in a person's hand for manipulation and having opposite outer surfaces, at least one hole in said body member having a hole longitudinal axis and a hole peripheral surface, said hole extending completely through said body member across said outer surfaces to define entrance openings to said hole, said entrance openings being inwardly sloped toward said axis of said hole for guiding the ends of generally cylindrical members into said hole, said hole being lined with scarifying material for receiving at least the ends of generally cylindrical members to scarify the exterior surfaces of same, and yieldable biasing means positioned between said scarifying material and said peripheral surface for normally biasing said scarifying material toward said axis and allowing yielding movement of said scarifying material away from said axis.

10. A tool for scarifying at least the ends of generally cylindrical areas comprising: a generally rigid body member, a brush including an elongated central twisted wire spine having bristles secured thereto along a portion of the spine length and having a spine end portion free of bristles, an elongated mounting member secured to a straight and undeformed length of said spine end portion against axial and rotational movement relative thereto without relying upon lateral deformation of said spine end portion to prevent either axial or rotational movement between said mounting member and said spine end portion and without the use of mechanical fasteners, said mounting member including a longitudinal portion extending along said spine and a transverse portion extending transversely of said longitudinal portion, said body member including a pair of separable parts between which longitudinal and transverse grooves are formed in said body member, and said longitudinal and transverse portions of said mounting member being respectively received in said longitudinal and transverse grooves to secure said mounting member to said body member against axial and rotational movement relative thereto.

11. The tool as defined in claim 10 wherein said mounting member comprises opposed parts secured together on opposite sides of said spine end portion.

12. A brush for use with a scarifying tool or the like of the type including a pair of opposed parts between which the brush is secured, said brush comprising: an elongated central twisted wire spine having bristles secured thereto along a portion thereof and having a spine end portion free of bristles, an elongated mounting member receiving said spine end portion and being clamped in tight gripping relationship to a straight and undeformed length of said spine end portion against axial and rotational movement without relying upon lateral deformation of said spine end portion to prevent either axial or rotational movement between said mounting member and said spine end portion and without the use of mechanical fasteners, and said mounting member having a longitudinal portion extending along said spine and a transversely extending free end portion which extends transversely of said longitudinal portion, said mounting member being non-threadably receivable between opposed parts of a scarifying tool for holding the brush to the tool against axial and rotational movement relative thereto.

13. The brush as defined in claim 12 wherein said mounting member comprises opposed parts secured together on opposite sides of said spine end portion.

* * * * *